United States Patent [19]

Figa

[11] 4,007,929

[45] Feb. 15, 1977

[54] COLLAPSIBLE GAME RACKET

[76] Inventor: Rubin Figa, 100 Lawn Terrace, Mamaroneck, N.Y. 10543

[22] Filed: Apr. 18, 1975

[21] Appl. No.: 569,489

[52] U.S. Cl. ..... 273/73 R; 273/73 C; 273/73 G; 273/73 J; 403/348; 403/353

[51] Int. Cl.[2] ..... A63B 49/02

[58] Field of Search ..... 273/73 R, 73 C, 73 F, 273/80 R, 80 D, 80.1, 81.2, 73 G, 73 H, 73 J; 43/18 R; 64/3, 4, 6, 9 R, 10, 15 R, 23; 74/527; 280/11.13 K; 403/348, 349, 353–361, 316, 317, 326–328, 315

[56] References Cited

UNITED STATES PATENTS

| | | | |
|---|---|---|---|
| 1,130,726 | 3/1915 | Greve | 403/348 X |
| 1,199,690 | 9/1916 | Gillan | 403/348 X |
| 1,332,898 | 3/1920 | Hossie et al. | 403/349 X |
| 3,601,399 | 8/1971 | Agens | 273/80.1 X |
| 3,815,380 | 6/1974 | Esmay | 403/349 X |
| 3,833,218 | 9/1974 | Frenkel et al. | 273/73 J |
| 3,854,832 | 12/1974 | Cowper | 403/349 |

FOREIGN PATENTS OR APPLICATIONS

| | | | |
|---|---|---|---|
| 1,903,722 | 8/1970 | Germany | 273/73 C |
| 325,427 | 2/1930 | United Kingdom | 273/73 G |
| 285,690 | 2/1928 | United Kingdom | 403/349 |

*Primary Examiner*—Richard J. Apley
*Attorney, Agent, or Firm*—Lackenbach, Lilling & Siegel

[57] ABSTRACT

A collapsible game racket of generally two-piece construction for tennis or other like sports requiring a head portion having strings and a connecting handle portion. The head and handle portions are detachably connected within the throat area by means of an interlocking and mutually cooperatively associated male and female elements which are fixedly retained in place to the handle and head portions.

5 Claims, 19 Drawing Figures

FIG. 7
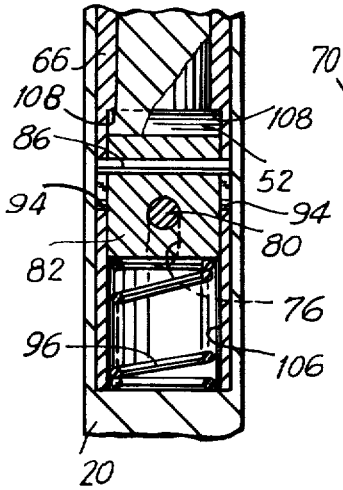
FIG. 8
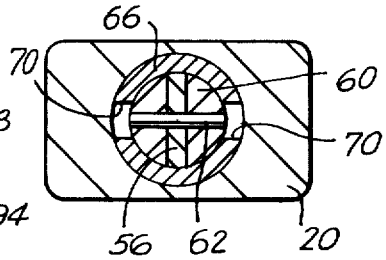
FIG. 9
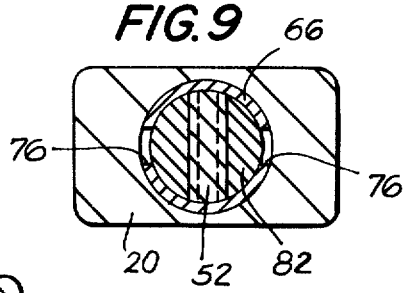
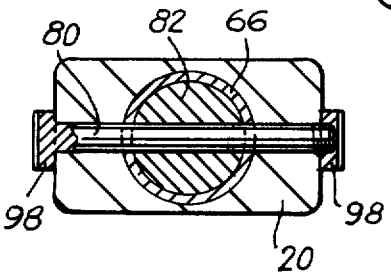
FIG. 10
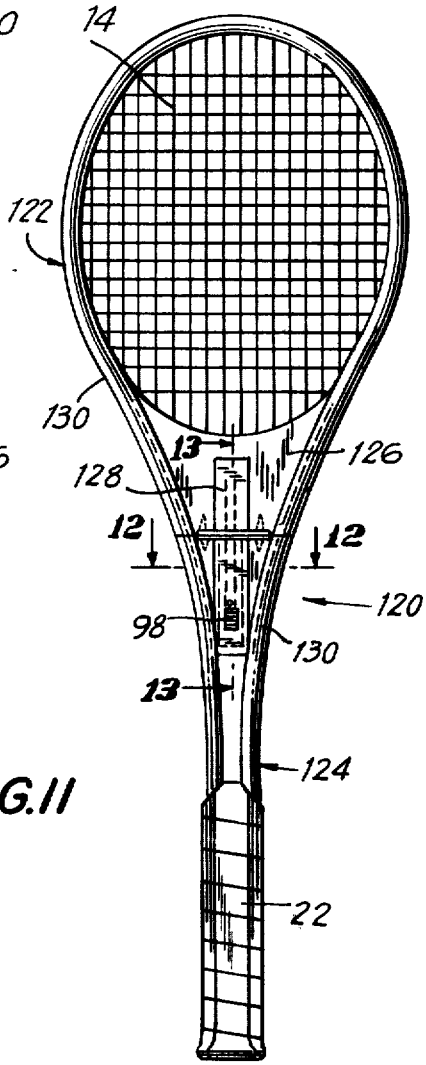
FIG. 11
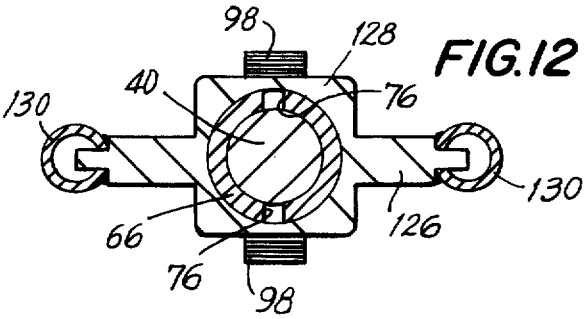
FIG. 12

COLLAPSIBLE GAME RACKET

BACKGROUND AND SUMMARY OF THE INVENTION

This invention relates to a connecting joint generally adapted for use in a collapsible game racket, and more particularly to a game racket, such as used in playing the games of tennis, squash, badminton or other like games involving a racket for striking a ball.

Heretofore in the art, there are known game rackets having a head portion and a detachably connected handle portion. These rackets are usually of the type employing some sort of tie-rod as shown in U.S. Pat No. 3,833,218. In this particular structure, the handle has at least one partially threaded bolt axially extending the length of the handle, and with the threaded portion extending beyond one end thereof. An internally threaded insert secured in the throat area of the head portion receives the bolt for locking the handle securely thereto; and mating guide means are also provided on the throat and handle portions for properly aligning the head and handle together as a unit. Many other United States patents are also primarily directed to tie-rod arrangements for securely holding the two basic elements or portions of a racket together. For example, in U.S. Pat. No. 1,548,134, the handle is screwed onto the head portion and generally locked into position by spring loaded bolts. Another racket construction is shown in U.S. Pat. No. 1,673,614 wherein the handle is pivotably and detachably secured to the head portion. In U.S. Pat. No. 2,109,799, the handle is divided into two portions, each pivoting about the head portion and both being detachable therefrom also. Another collapsible racket illustrated in U.S. Pat. No. 1,897,515 teaches a handle coupled to the head by means of a cross-type connection joint which is screwed together to fixedly hold in place the head portion on the handle portion.

However, one of the disadvantages of such racket constructions resides in their weight. As is well-known, the overall weight of a given racket structure should preferably be the range widely acknowledged as coming within generally accepted weight ranges.

Another disadvantage of such detachable racket constructions is that there is no positive locking action between the two elements and, consequently, as a result thereof, such racket structures were not widely accepted by the trade, particularly since they tended to differ widely under various operating conditions. Moreover, such rackets required strong arms and hands in order for one to adequately tighten his or her racket so as to maintain the required positive locking action.

A further serious defect in such racket constructions of the prior art is that they were not easily assembled and disassembled, since many of them required the use of tools, such as a screwdriver, and furthermore, were complicated and difficult for one to operate. Most of the prior art collapsible rackets also exhibited a tendency to "twist" during play inasmuch as they did not incorporate a positive locking action or force tending to retain exactly in place the position of the racket head with respect to the handle portion.

Accordingly, the principal object of the present invention is to provide a novel racket construction of the collapsible type wherein the handle portion is detachable from the head portion.

Another object of the invention is to provide a racket construction wherein a positive locking action is achieved between the interconnecting male and female engaging elements.

A further object of the invention is to provide a collapsible racket structure which is adaptable to basically any kind of materials conventionally employed for a one-piece racket, such as wood, metal or compositional materials.

Yet a further object of the invention is to provide novel cooperatively associated male and female elements which positively interlock the handle to the racket head.

It is still a further object of the invention to provide a collapsible racket having the advantageous characteristics mentioned in the preceding paragraphs, and one which is durable and extremely strong and one which is also capable of economic manufacture.

Other objects of the present invention will become apparent upon reading of the following specification and refering to the accompanying drawings, which form a material part of this disclosure.

The invention accordingly consists in the features of construction, combinations of elements, and arrangement of parts which will be exemplified in the construction hereinafter described, and of which the scope will be indicated by the appended claims.

BRIEF DESCRIPTION OF THE DRAWINGS

FIG. 7 is a fragmentary sectional view, taken along the line 7—7 of FIG. 6;

FIGS. 8–10 are cross-sectional views, taken, respectively, along the lines 8—8, 9—9, and 10—10 of FIG. 6;

FIG. 11 is a front elevational view of an alternate embodiment of the invention, particularly applicable to a metal tennis racket, such as a steel, aluminum or other metal alloy rackets;

FIG. 12 is a cross-sectional view, taken along the line 12—12 of FIG. 11;

DESCRIPTION OF THE PREFERRED EMBODIMENTS

Figure 1:
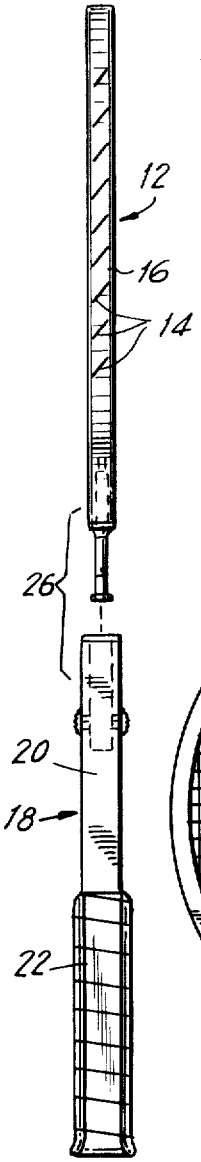
FIG. 1 is a side elevational view of a collapsible racket of the present invention, shown in a disconnected condition at the throat portion of the racket.
Figure 1:
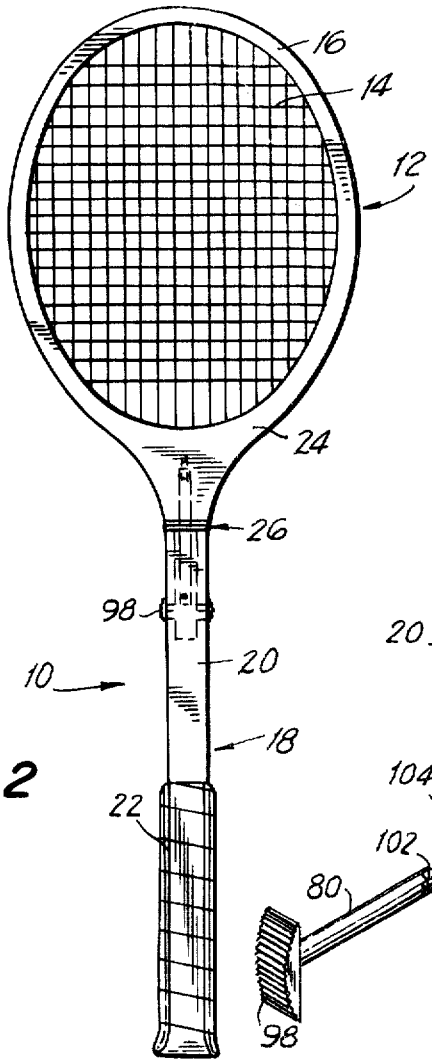
Figure 2:
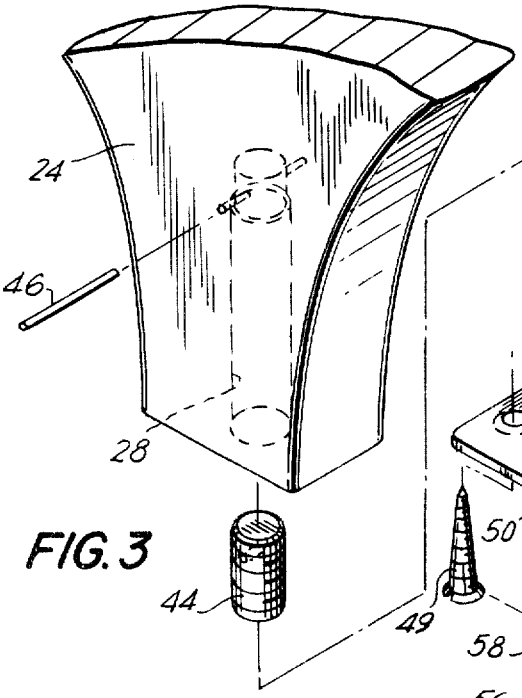
FIG. 2 is a front elevational view of the collapsible racket of FIG. 1, but illustrated in the assembled or connected condition.
Figure 3:
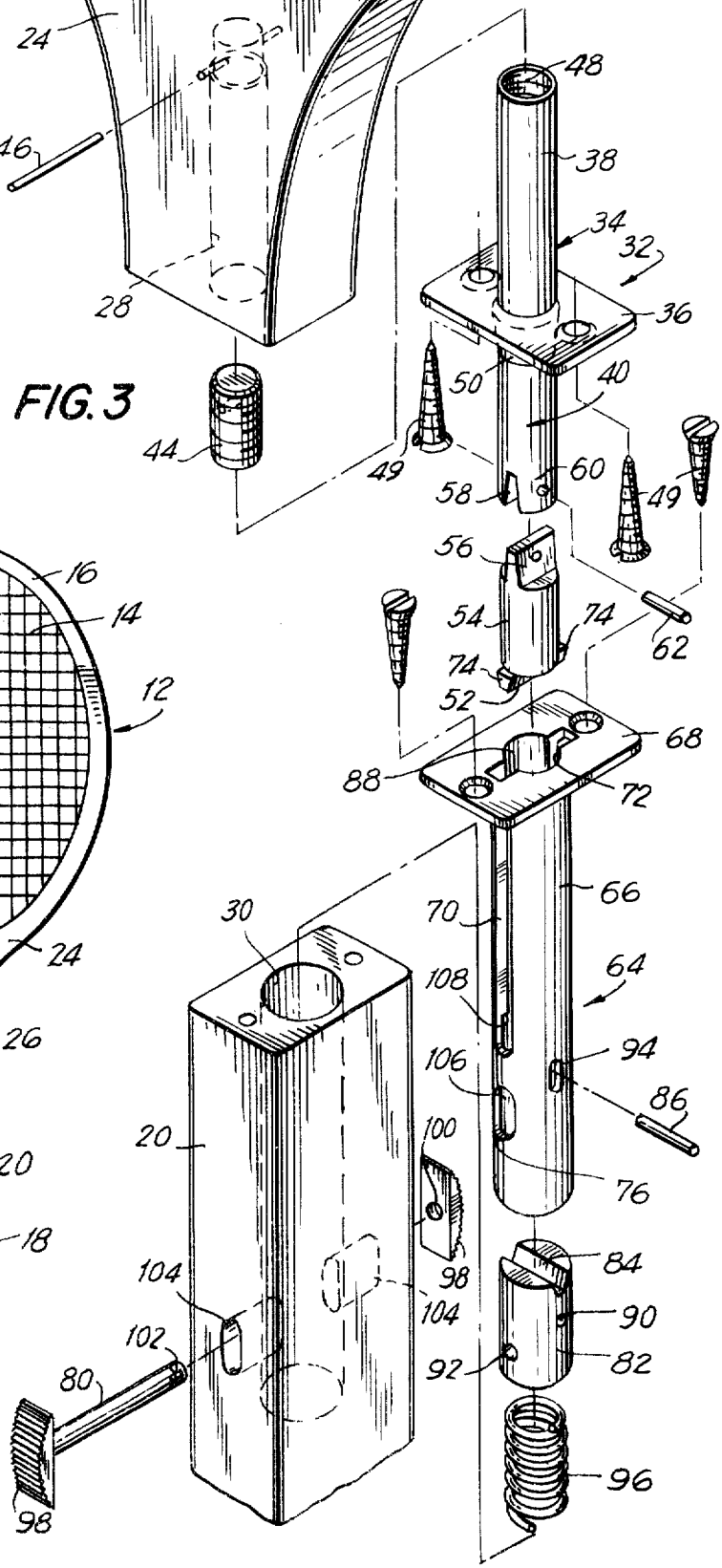
FIG. 3 is an exploded perspective view of the interlocking innards of the collapsible racket shown in FIGS. 1 and 2, with the racket head and handle portions partially broken away.

Referring now to the drawing and particularly to FIGS. 1–3, there is shown a novel collapsible racket 10, generally adapted for playing the game of tennis. Although the rackets disclosed, described and illustrated herein are directed primarily to the game of tennis, it is to be recognized that such constructions are also applicable to other sports or games, such as squash, badminton or even paddle ball. In its broadest application, the invention is also applicable as a quick-disconnect joint or connection between two elements or parts. For example, a fishing rod could also be constructed of a plurality of sections or portions joined together as an assembled unit using a number of the interconnecting or interlocking connection joints of the present invention.

As best shown in FIGS. 1 and 3, the racket 10 comprises a racket head portion 12 containing conventional interwoven nylon strings, wire, cat or sheep gut 14 supported by the frame 16 of the head portion in conventional and well-known manners which do not form a part of this invention. The face of the head portion 12 is generally oval in shape, but may also be of other shapes, such as round or circular in those racket constructions, which utilize same, namely, squash or badminton.

The racket 10 further comprises a handle portion 18 having a body portion 20, and a gripping portion 22 having a conventional plastic, rubber or leather grip spirally wound about the gripping portion 22 of the handle 18. Although the racket may be of other materials, such as graphite, fiberglass or other composite or plastic composition like materials, the embodiment of FIGS. 1–10 is made of wood. An integrally formed wooden throat 24 forms the lower portion of the frame 16 and the racket 10 is provided with a joint area 26 intermediate the throat 24 and handle portion 18.

In FIG. 3, the racket head 12 and the handle portion 20 are respectively provided with generally axially extending bores 28 and 30 adapted to fixedly receive in place mutually cooperatively associated connecting elements, which interlock together to form as a unitary one-piece assembly the collapsible tennis racket of the present invention. The head lock piece or male interlock element 32 comprises a rod-like element 34 having a flange portion 36 extending radially outwardly therefrom. One end 38 of the rod 34 extends into the bore 28 and the other end 40 constitutes the male engaging element. The end 38 is suitably secured in any manner to the bore 28 in the throat portion 24. In the embodiment shown, the bottom of the blind bore 28 is provided with a threaded rod-like nipple 44 fixedly pinned in place in a transverse manner by the pin 46 extending through the throat portion 24. The nipple 44 may also be suitably secured during manufacture without a pin, to the head, as for example by adhesives.

The rod element 34 at end 38 is suitably threaded internally as at 48 to engage the nipple 44 so as to enable the male interlock element 32 to be snugly seated and tightly pulled into the bore 28 with the flange portion 36 disposed in proper alignment upon bottoming out or seating of the element 32 in place in the bore 28. Suitable fasteners, such as flat head wooden screws 49 may be used to further secure the flange 36 and male element 32 to the racket head portion 12. Machine screws (not shown) may also be used, but in such cases suitable inserts anchored in the wood would be required in the throat portion 24 for receiving and providing the means for the threaded engagement of the screws. If desired, suitable pins, which may be for alignment and strengthening purposes, as shown and described hereinafter in connection with the modification of FIGS. 16–19, may also be provided in this embodiment of the invention.

The portion of the end 40 close to the flange 36 is preferably provided with a taper 50, as will be explained in greater detail in connection with the operation of the collapsible tennis racket. The distal end portion is provided with a transverse key 52, preferably made integrally with the rod 40. This key 52 is relatively short in height as measured axially along the rod 40, and is slightly longer in length than the diameter of the rod 40 so that its free ends 74 jut or extend outwardly a small distance from opposite sides of the rod 40 generally in a direction orthogonal or at right angles to the major axis of the flange portion 36.

In the specifically illustrated embodiment of FIG. 3, the rod's other end 40 (that is, the portion of the end 40 furthest away from the flange 36) is shown as being suitably made in two sections or pieces. A lower distal part or element 54 having the transverse key 52 is preferably a magnet or made of a suitable magnetic material, and is provided with a central flat male tapered extension 56 adapted to be engageable with a correspondingly centrally located flat walled female generally V-shaped cutout 58 provided in the other end or part 60 or element of the rod 34. A pin 62 is used to rigidly lock the two piece rod 40 together as a unit, through the tapered tongue and groove joint.

The handle lock piece or female interlocking element 64 comprises a tubular portion 66 having a flange portion 68 at one end thereof formed preferably integrally therewith. The tubular portion 66 which forms a first recess means is provided with opposing slots 70, 72 for accommodating the ends 74 of the key 52 jutting beyond the diameter of the rod 40, as will be explained hereinafter in greater detail in connection with the operation of the invention. The slots 70, 72 extend along a substantial portion of the tube or hollow rod and also completely extend through the flange portion 68.

Screws 49, in a like manner as in connection with the male interlock element 32, are also used to locate in place, align and maintain the flange portion 68 of the female interlocking element 64 to the handle portion 20. In the lower end of the tube 66, a pair of opposing clearance slots 76, 78 are provided. These slots 76, 78 allow for the transverse passage and slight axial movement of a cross-pin 80 passing through a stop-lock or mating female keyway element 82 having a tapered groove 84, and being also preferably made of a magnetically attractive material. The generally V-shaped tapered groove or slot 84 accommodates and rotationally locks the correspondingly V-shaped tapered key 52 from any such movement and by the parts 54 and 82 being magnets or made of magnetically attractive material, the final and proper seating of the interlocking elements is greatly enhanced. This tapering feature is known conventionally as a Jacobs taper in the trade.

Pin 86 secures axially in place the position of the female keyway element 82 within the hollow bore 88 of the tube 66. The aperture 90 holding the pin 86 in position passes through the element 82 at about a right angle with respect to the aperture 92 which accommodates passage of the rod 80. Slots 94 provided on opposite sides of the tube 66 limit the travel of the female keyway element 82 in the bore 88 of the tube 66, as will appear presently.

Figure 4:
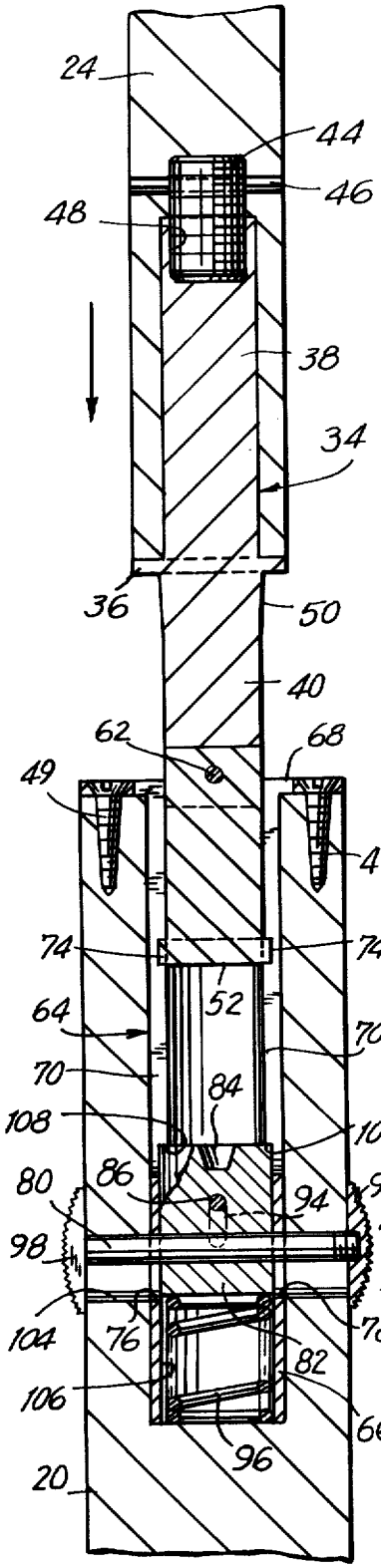
FIGS. 4–6 are partial, longitudinal sectional views of the collapsible racket of FIGS. 1–3, showing the interlocking innards and the steps of connecting and/or disconnecting the racket head from the handle portion.
Figure 5:
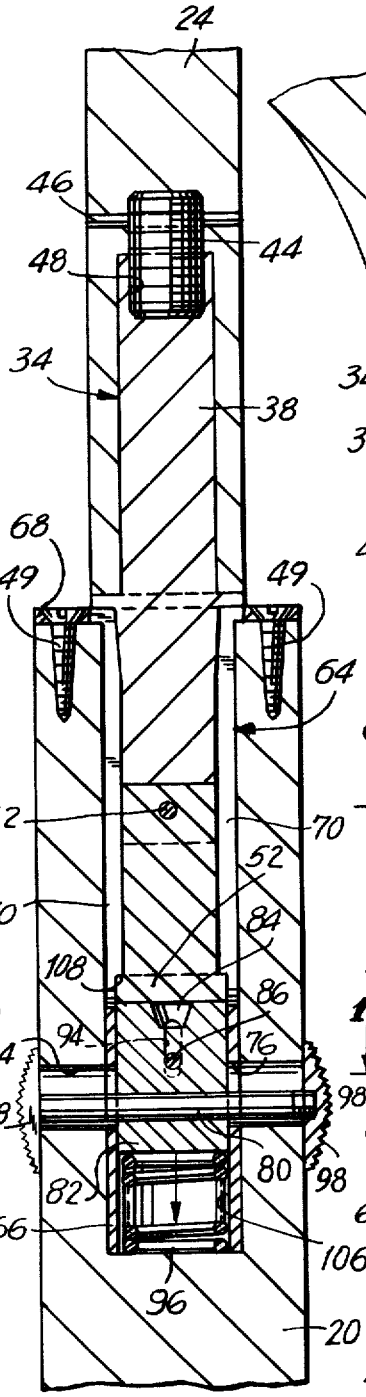
Figure 6:
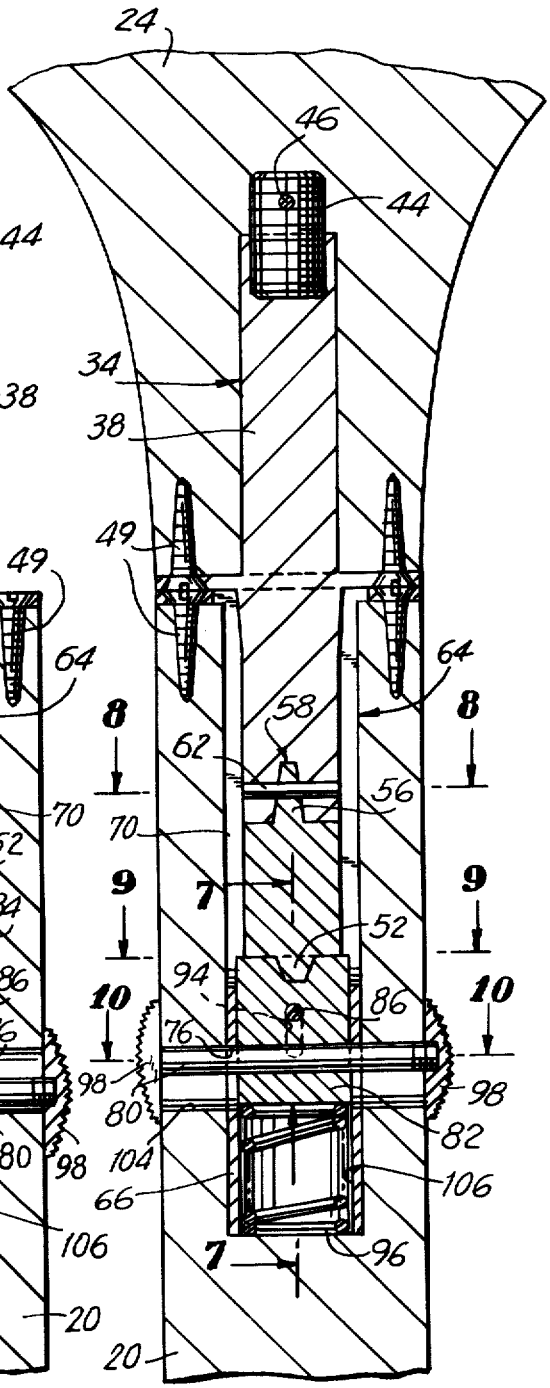

A compression spring 96 seating within the lower end of the bore 88 of tube 66 urges or biasingly tends to force the female keyway element 82 upwardly, as best shown in FIGS. 4 and 6. A spring support in the form of a small shallow cup-shaped washer-like element (not shown) may be employed at the base of the blind bore 30 in the handle so as to provide a good support for the bottom end of the spring 96.

Suitable lock release slides or elements 98 may be provided on either side or end of the rod 80. In the illustrated embodiment, one slide of element 98 has a threaded blind hole 100 and thus is suitably threaded on the threaded end 102 of rod 80 and the other slide or element is integrally formed with the rod 80. However, both elements 98 may be press fitted about the ends of a straight pin or rod 80; and the overall form or outer surfaces thereof may be of various shapes or forms and further may be suitably knurled as shown so as to facilitate a better gripping action with one's fingers during assembly and disassembly of the racket. The elements 98 should also preferably be short in height and relatively contoured so as to minimize wind resistance and otherwise provide no distractions or obstruction to a player using the racket. In this connection, such elements 98 may be suitably recessed in grooves provided in the sides of the handle, thereby being completely out of the way of one's hands, and moreover being essentially obscured from view. Clearance passages 104 are provided on opposite sides of the handle 20 for permitting passage of the rod 80 through the handle and movement of the rod 80 (including locking device) axially in response to the spring action against the female lock element 82 during operation of the device.

The diameter of the female lock element 82 is slightly greater than the diameter of the bore 88 in tube 66 so that the bore 106 in the lower end of the tube 66 is larger and opposing arcuate ledges or shoulder faces 108 are formed between the two bores 88 and 106 and are thus considered as second recess means. These shoulders 108, when the rod 40 is rotated after the flanges 36 and 68 come together as will appear presently, engage with both ends 72 of the key 52 and axially lock the "head lock" or male element 32 to the "handle lock" or female element 64.

FIGS. 4–6 and 7–10 best illustrate the interlocking engagement of the locking elements. In operation, the male element 32 is initially guided downwardly as shown by the reference arrow in FIG. 4 into the female element 64 with the ends 74 of key 52 sliding along and guided by the slots 70 which extend not only along the upper portion of the tube 66, but also completely through the flange 68. When the bottom of the key 52 touches the top of the female lock element 82, the spring 96 is compressed, as best shown by the reference arrow in FIG. 5, by forcing the rod 34 further down into the bore a distance equal to the axial height of the key 52, the flanges 36 and 68 then contacting each other. This procedure and the rotation of approximately 90 degress permits the flanges 36 and 68 to be aligned together, or coincide with respect to each other as shown in FIG. 6, simply locks firmly in place the two-piece collapsible tennis racket with the ends 74 of the key 52 engaged against the shoulders 108 formed by the bores 88 and 106 in the female locking element 64.

Figure 13:
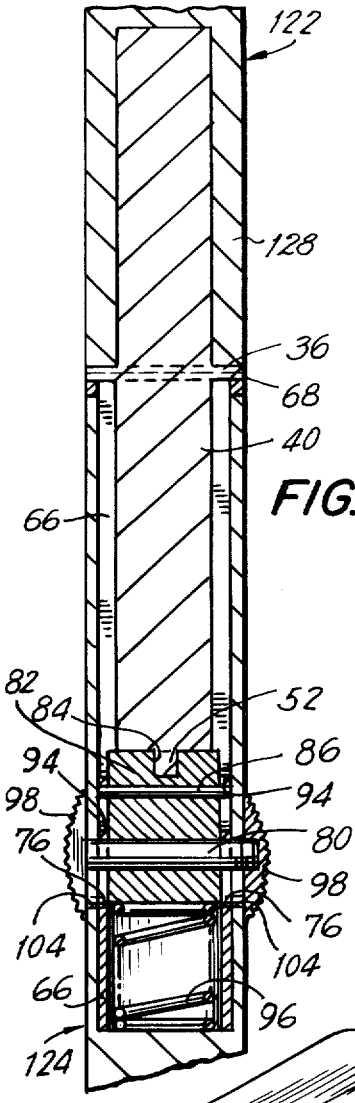
FIG. 13 is a fragmentary sectional view, taken along the line 13—13 of FIG. 11.

In the alternate modification of the invention shown in FIGS. 11–13, there is illustrated a collapsible metal tennis racket 120 having a head portion 122 and a handle portion 124. The throat portion 126 generally comprises a housing portion 128 suitably supported by the metal frame 130. Lightening holes (not shown) may be provided in the throat portion 126 so as to reduce the weight thereof, if necessary. In basically all other aspects of this modification, the invention described hereinbefore in connection with FIGS. 1–10 is the same and involves identical or like parts having the same reference numeral (only a few being shown) including the slide elements 98, which only differ in that they are disposed in a plane perpendicularly to the plane of the racket, rather than in the plane of the racket as in the wooden racket embodiment of FIGS. 1–10. Other minor differences are that the key 52 has parallel flat faces rather than tapering faces which form the V-shaped key 52 of FIG. 3 and that the rod 40 is of one-piece construction rather than two. Of course, this unitary rod may also be magnetic material as well as the female keyway element 82, if desired.

Figure 14:
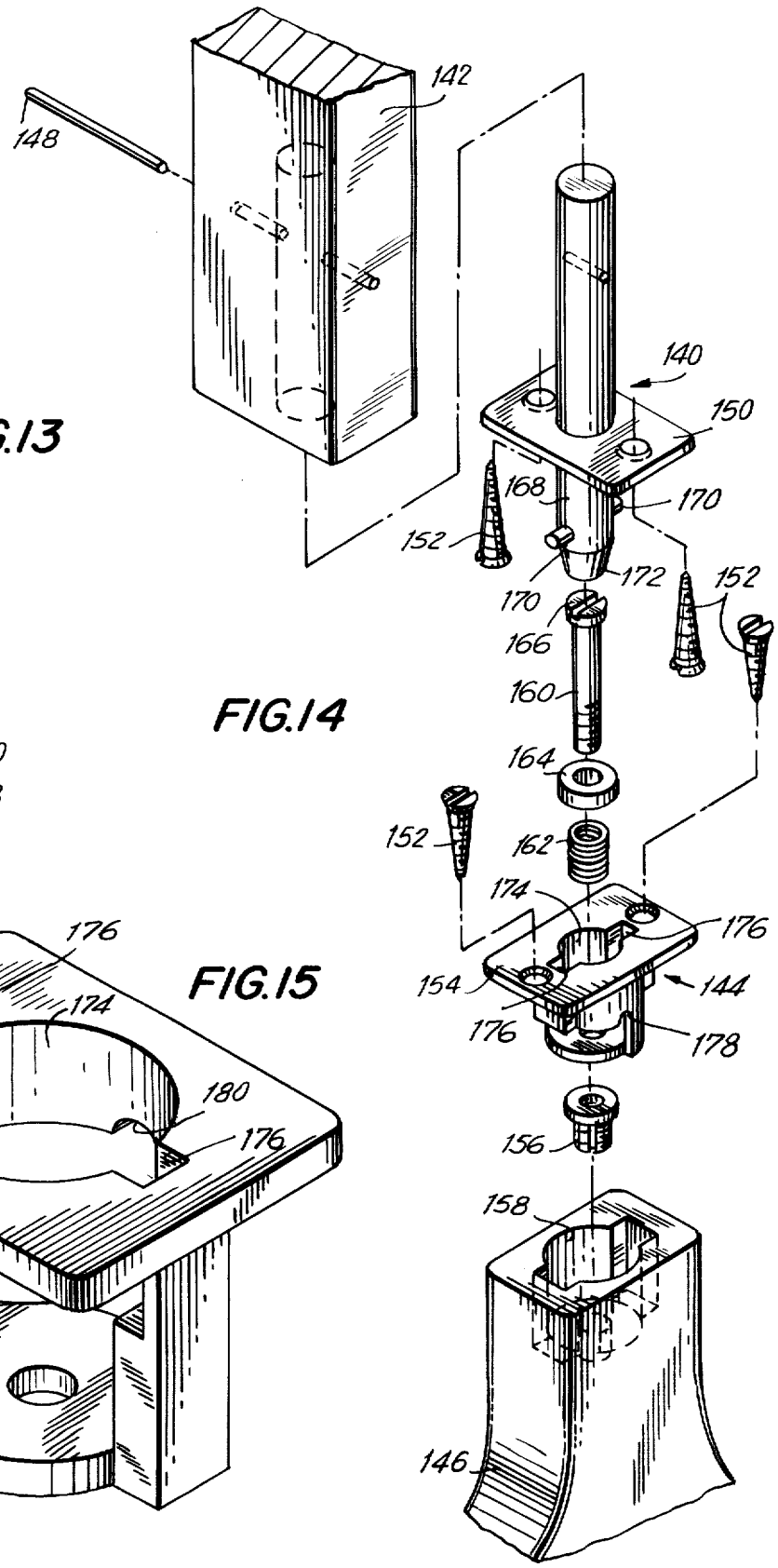
FIG. 14 is an exploded, perspective view of another alternate embodiment of the invention, wherein the male interlocking element is attached to the handle and the female interlocking element forms a part of the racket head.
Figure 15:
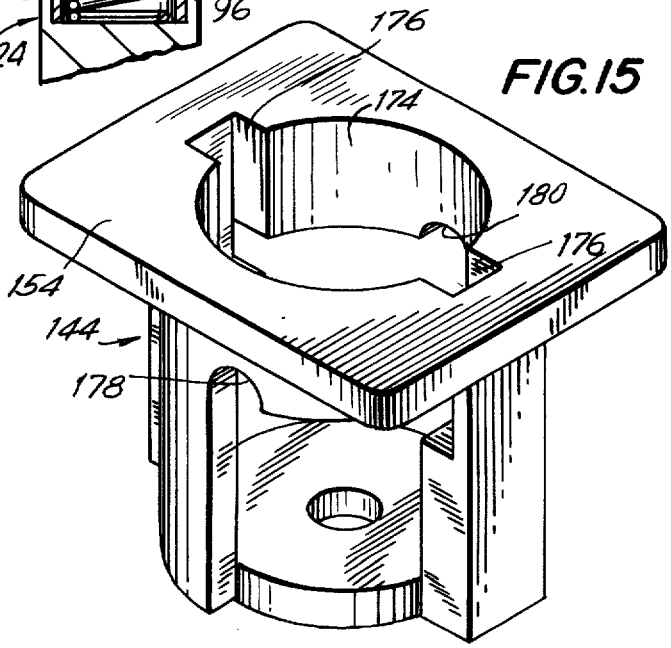
FIG. 15 is an enlarged perspective view of the female interlocking element shown in FIG. 14.
Figure 16:
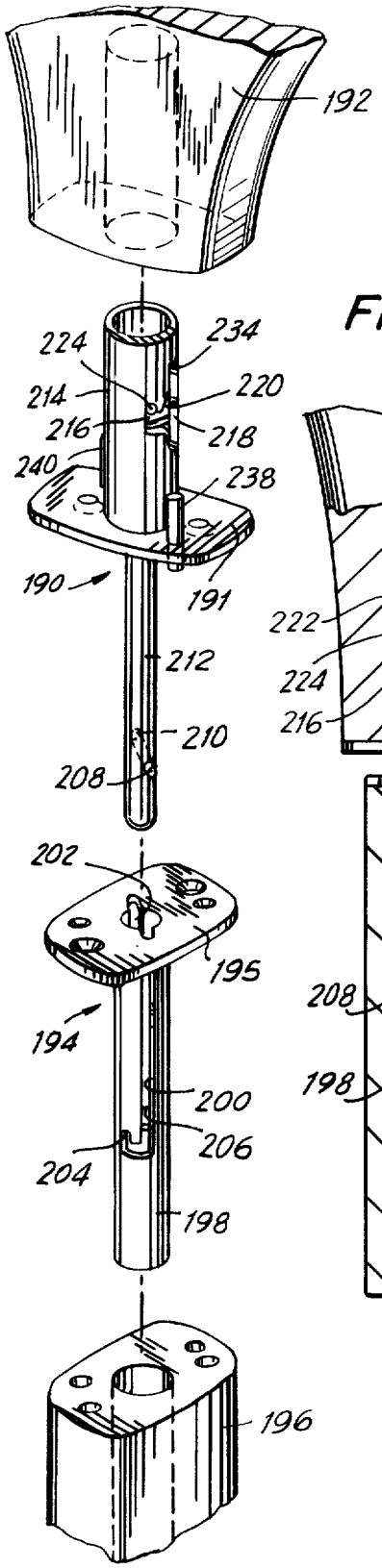
FIG. 16 is a further modification of the invention, showing in an exploded, perspective view, the interconnecting elements, and the racket head and handle portions being partially broken away.

The modification of FIGS. 14–15 employs a male locking element 140 in the handle portion 142, and a female locking element 144 in the racket head 146. In this structure which is the reverse of those shown with respect to the inventions of FIGS. 1–13, the male element 140 may be suitably pinned in place by a pin 148 to the handle 142; and the flange portion 150 thereof may also be suitably fastened or screwed down onto the cross-sectional surface portion of the handle by means of the flat head screws 152. In a like manner, similar screws 152 suitably hold in place the flange 154 of the female element 144. In addition, a threaded insert 156 is suitably secured, such as by pinning or the use of adhesives, in the base of the cavity 158. A spring loaded shoulder bolt 160 is biasingly urged upwardly by the action of a compression spring 162 bearing against a washer-like device 164 disposed beneath the head 166 of the bolt 160, the latter of which is threaded into the insert 156.

The lower portion 168 of the male element 140 is provided with a pair of radially outwardly extending rod-like elements 170 and a conical tip portion 172 for facilitating entry into the cavity 174 of the female element 144. This cavity 174 at its rim portion may be suitably tapered as with a Jacob's taper, as may also be provided on the upper end of the lower portion 168 of male element 140 beneath flange 150, thus achieving a more proper and final or complete and satisfactory seating of the interlocking elements in substantially a tight "home" sought fit.

A pair of slots 176 guide the rod-like extensions 170 into the female element 144. Once the tip of the conical portion 172 comes into contact with the top of the bolt 160, forces must be exerted downwardly or upwardly, as desired, to overcome the spring 162 and thereby permit the flanges 150 and 154 to contact each other, and thus also permit the handle 142 to be subsequently rotated allowing the extensions 170 to be locked in place in mutually cooperatively associated grooves 178 and 180 provided generally orthogonal to the axis of the slots 176. Once the two extensions 170 are urged into the grooves 178 and 180 by the spring 162, the spring 162 continues to maintain the position of the lower portion 168 of the male element 140 firmly in place forming the collapsible racket. A disadvantage, however, of such a construction resides in the possibility of the extensions 170 "snapping" or riding up and out of the grooves 178 and 180 upon the racket face or head being subjected to a rather severe twisting or rotational action, as might possibly occur if a tennis ball is not struck centrally of the stringed net.

A further modification of the invention which clearly overcomes the disadvantage of the previously described device is shown in FIGS. 16–19. As shown, therein, a male locking element 190 having a flange 191 is suitably mounted and secured to the racket head 192, and a female locking element 194 having a flange 195 is suitably mounted and secured to the handle portion 196. In this structure, the female element 194 is a hollow tube like element 198 having a pair of opposing slots 200 and 202. The lower ends of the slots 200 and 202 are further formed in a J-shape having upwardly extending pin receiving portions 204 and 206 which provide the means for holding and locking in place the pin or rod-like extensions 208 and 210 on the rod 212 of the male locking element 190.

The male element 190 further comprises an upper hollow housing portion 214 and a pair of cammed areas each formed generally by a short slot 216 and a long slot 218 connected by means of an interconnecting slotted area 220. The short slot 216 is provided with an upwardly extending pin receiving portion 222, similar to a bayonet lock, for holding and locking in place the pin or rod-like extensions 224 and 226 extending radially outwardly from a pin 228 passing through an end portion 230, which may or may not be an integral part, of the rod 212.

A compression spring 232 constantly urges the extensions 224 and 226 of the rod 212 upwardly into either the pin receiving portions 222 or the upper ends 234 of the long slots 218.

Figure 17:
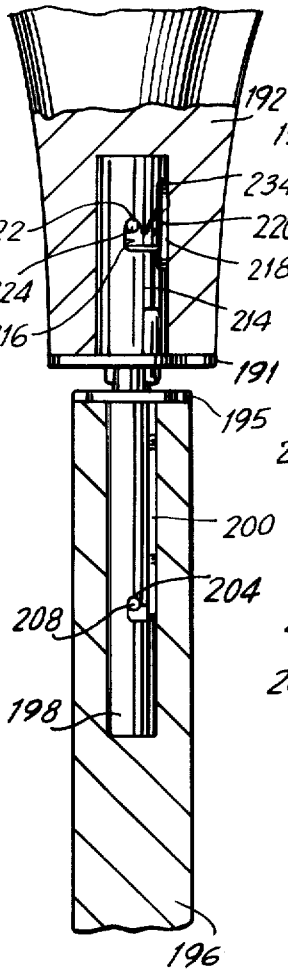
FIGS. 17–19 are partial, longitudinal sectional views of the modified collapsible racket shown in FIG. 16, illustrating the interconnecting innards and the steps of connecting and/or disconnecting the racket head from the handle portion.
Figure 18:
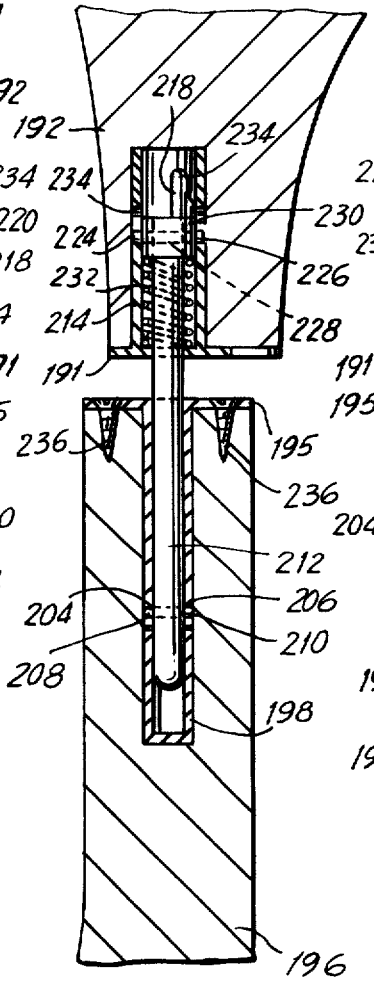

FIG. 17 represents an initial or first step or operation wherein the rod 212 has been inserted into the hollow female element 198 and rotated to engage the pin extensions 208 and 210 in the pin-receiving portions 204 and 206 of the J-shaped slots 200 and 202. A second step or operation involves pulling the racket head 192 and handle portion 196 apart so as to compress the spring 232 and increase the spacing (see separation difference in both FIGS. 17 and 18) between the flanges 191 and 195 and thus release the pin extensions 224 and 226 from the pin-receiving portions 222.

Figure 19:
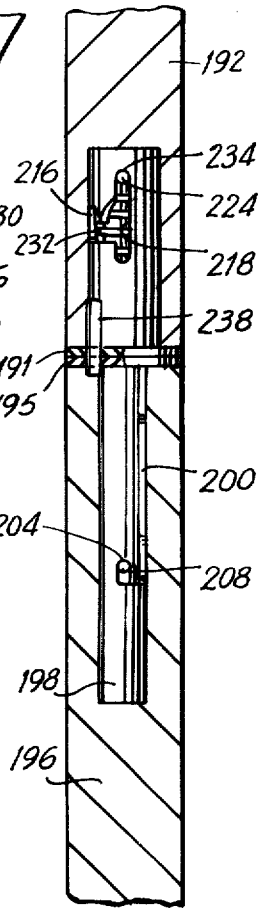

FIG. 19 represents basically the third or final operation and step wherein the rod 212 is further rotated in the same direction as in the first or initial step while substantially simultaneously releasing the handle portion 196, whereby the spring 232 pulls the two portions of the racket together tightly in place with the flanges 191 and 195 aligned and contacting each other, as best shown therein.

Suitable flat head screws 236 may be used to hold the flanges 191 and 195 (only those screws shown with respect to flange 195) in place to their respective portions of this alternate collapsible tennis racket of the present invention. Suitable pins 238 and 240 may also be provided so as to completely extend through both flanges 191 and 195, thereby precluding any twisting or rotational action of the racket head 192 if a tennis ball is struck off center of the stringed area.

It will be appreciated that the male and female locking elements are preferably made of strong corrosive resistant metal, such as stainless steel, although many other metals or alloys thereof can also be utilized. The rackets of the present invention can be suitably equipped with any size grip, whether light, medium or heavy (about 4¼ inches through about 4⅞). The rackets are also within the general weight ranges of most other commercially avialable rackets, such as the wood, metal, fiberglass or other composite structures. The weight/strength ratios of the rackets of the present invention are considered comparable to present day marketed rackets of a one-piece construction.

It will also be apparent that threaded inserts and machine screws are preferably desired in those applications where screws are utilized for fastening the flanges of both the male and female locking elements respectively to the head and handle portions of the racket. The two parts of the racket should also be suitably marked on a top or bottom surface so that the racket is assembled in the same manner each time. This mark may simply comprise a scribe line so that the balance of the racket would not be upset, as would occur in a case where the opposite racket face was assembled to the scribed handle portion.

Collapsible rackets of the present invention perform satisfactorily on any type of court and professional or expert players generally consider them to be an equally adequate match or equivalent to the universally employed unitary one-piece wooden and metal rackets.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

What is claimed is:

1. A collapsible racket for tennis or the like, comprising: a head portion having a frame terminating in a throat area; a handle portion having a gripping area at one end thereof; a male locking element positioned generally in said throat area and being generally axially disposed in one of said portions, said male locking element having an extending portion, said extending portion having a key transversely disposed across a distal end portion thereof, said key being a magnetic piece; a female locking element, which is mutually cooperatively associated with said male locking element, positioned generally in said throat area and being generally axially disposed in the other of said portions said female locking element having a first recess means interengageable with said extending portion, said female locking element having a female keyway element axially disposed in said first recess means and said female keyway element having means thereon operatively associated with pin means, which extend through said female keyway element, for limiting the axial movement of said female keyway element, said female keyway element having a keyway transverse of its top surface, said keyway facing toward said one of said portions, said keyway being engageable with said key for precluding rotational movement of said male locking element, said keyway being a magnetic piece; and biasing means being axially disposed in either said handle portion or said head portion, said biasing means constantly urging said head and handle portions together when said head and handle portions are interconnected together, and said biasing means constantly urging said female keyway element toward said one of said portions; whereby said head and handle portions are locked together as an assembled unit and whereby rotational and axial movements between said male and female locking elements are precluded.

2. The collapsible racket according to claim 1, wherein said key and said keyway are attracted to each other magnetically.

3. A collapsible racket for tennis or the like, comprising: a head portion having a frame terminating in a throat area; a handle portion having a gripping area at one end thereof; a male locking element positioned generally in said throat area and being generally axially disposed in one of said portions, said male locking element having an extending portion; a distal end portion of said male locking element rigidly fastened to said extending portion, said distal end portion having a key transversely disposed across it; a female locking element, which is mutually cooperatively associated with said male locking element, positioned generally in said throat area and being generally axially disposed in the other of said portions, said female locking element having a first recess means interengageable with said extending portion, said female locking element having a female keyway element axially disposed in said first recess means and said female keyway element having means thereon operatively associated with pin means, which extend through said female keyway element, for limiting the axial movement of said female keyway element, said female keyway element having a keyway transverse of its top surface, said keyway facing toward said one of said portions, said keyway being engageable with said key for precluding rotational movement of said male locking element; and biasing means being axially disposed in either said handle portion or said head portion, said biasing means constantly urging said head and handle portions together when said head and handle portions are interconnected together, and said biasing means constantly urging said female keyway element toward said one of said portions whereby said head and handle portions are locked together as an assembled unit and whereby rotational and axial movements between said male and female locking elements are precluded.

4. The collapsible racket according to claim 3, wherein said key and said keyway comprise magnetic pieces.

5. The collapsible racket according to claim 4, wherein said key and said keyway are attracted to each other magnetically.

* * * * *